United States Patent [19]

Suyama et al.

[11] Patent Number: 4,526,014

[45] Date of Patent: Jul. 2, 1985

[54] WATER SPRAY UNIT FOR ICE PRODUCT MAKING MACHINE

[75] Inventors: Tomio Suyama, Toyoake; Kazuya Osawa, Nagoya, both of Japan

[73] Assignee: Hoshizaki Electric Co., Ltd., Toyoake, Japan

[21] Appl. No.: 661,325

[22] Filed: Oct. 16, 1984

[30] Foreign Application Priority Data

Oct. 18, 1983 [JP] Japan ..... 58-193422
Oct. 18, 1983 [JP] Japan ..... 58-193423

[51] Int. Cl.[3] ..... F25C 1/12
[52] U.S. Cl. ..... 62/347; 239/500
[58] Field of Search ..... 62/347; 239/500

[56] References Cited

U.S. PATENT DOCUMENTS 2,805,557 9/1957 Hilger ..... 62/347 X
2,997,861 8/1961 Kocher et al. ..... 62/347
3,206,944 9/1965 Gallo ..... 62/347
3,430,452 3/1969 Dedricks et al. ..... 62/347 X
4,412,429 11/1983 Kohl ..... 62/347
4,458,503 7/1984 Nelson ..... 62/347

*Primary Examiner*—William E. Topolcai
*Attorney, Agent, or Firm*—Wenderoth, Lind & Ponack

[57] ABSTRACT

The water spray unit is used in conjunction with an ice product making machine having an upright freezing plate or freezing plates, on the surface or surfaces of which a plurality of guide ribs or projections are vertically formed at a preset transverse distance from one another. The spray unit has a main body provided above the freezing plate or freezing plates and presenting a large number of spray apertures, and a plurality of water spray guide plates disposed between the guide ribs or projections and presenting a pair of upright side flanges. The spray water is discharged from the spray apertures and caused to descend along the freezing plate or freezing plates by way of the water spray guide plates, the upright side flanges and the guide ribs or projections as a turbulence-free uniform stream.

10 Claims, 11 Drawing Figures

WATER SPRAY UNIT FOR ICE PRODUCT MAKING MACHINE

BACKGROUND OF THE INVENTION

This invention relates to a vertical type of ice product making device and more particularly to a water spray unit for supplying ice-making water to a freezing plate of the ice product making device.

The typical construction of the water spray unit so far used in the art is shown in FIG. 1.

Referring to FIG. 1, an upright freezing plate 1 has an evaporator 2 of the cooling system and an upper flange 3 to which a mounting plate 5 in the form of a letter L is securely mounted by set screws 6. The mounting plate 6 carries a main body 4 of the spray unit having a large number of spray apertures 4*a*.

A deflector 7 and an ice-making water soucer or reservoir 8 are mounted below the freezing plate 1. The icemaking water in the reservoir 8 is transferred by a circulating pump 9 into the main body 4 of the spray unit. The ice-making water in the main body 4 of the unit is sprayed via spray apertures 4*a* onto the freezing plate 1 and caused to descend so that, after lapse of a certain time interval, ice products 10 are formed on the surface of the freezing plate 1.

In the above described prior art device, the spray apertures of the spray unit 4 are so far apart from the freezing plate 1 that the ice-making water is scattered to a variable extent in dependence upon the spraying direction of the icemaking water with respect to the freezing plate 1 and the discharge pressure of the ice making water circulating pump. Moreover, the uniform product makeup is obstracted by the turbulence in the ice-making water flowing down the freezing plate 1. Thus the mounting position of the main body of the spray unit and the size of the spray apertures need to be controlled finely in order to assure uniform formation of the ice products. Such situation is highly inconvenient for mass production of the ice product making apparatus. In addition, in the prior art apparatus, high precision in the mounting position of the spray unit cannot be attained because the mounting plate 5 carrying the main body 4 of the spray unit is positioned to the upper flange 3 of the freezing plate 1 only by set screws 6.

Thus, there is a strong demand for a water spray unit for an ice product making machine which is devoid of the above mentioned various deficiencies.

SUMMARY OF THE INVENTION

The water spray unit fabricated in accordance with the present invention is used in conjunction with an ice product making machine or apparatus having an upright freezing plate or freezing plates, on the surface or surfaces of which a plurality of guide ribs or projections are vertically formed at a preset transverse distance from one another. The spray nozzle has a main body provided above the freezing plate or freezing plates and presenting a large number of spray apertures, and a plurality of water spray guide plates disposed between adjoining the guide ribs or projections and presenting a pair of side flanges on both sides of the main portion thereof and a large number of spray apertures in the wall plate of the main body of the spray unit. The spray water is discharged from the spray apertures and caused to descend along the freezing plate or freezing plates by way of the water spray guide plates, the upright side flanges and the guide ribs or projections as a turbulence-free uniform stream.

According to a preferred embodiment of the present invention, the bottom plate of the main body of the spray unit has a depending lug and the freezing plate is clamped between the lug and the upright side flanges for setting the fixed position of the main body of the spray unit on the freezing plate.

BRIEF DESCRIPTION OF THE DRAWINGS

The present invention will become more apparent from the following description of a preferred embodiment thereof shown, by way of example only, in the accompanying drawings, wherein.

DETAILED DESCRIPTION OF THE PREFERRED EMBODIMENTS

The water spray unit for the ice product making machine or apparatus embodying the present invention is hereinafter explained by referring to the accompanying drawings.

Figure 1:
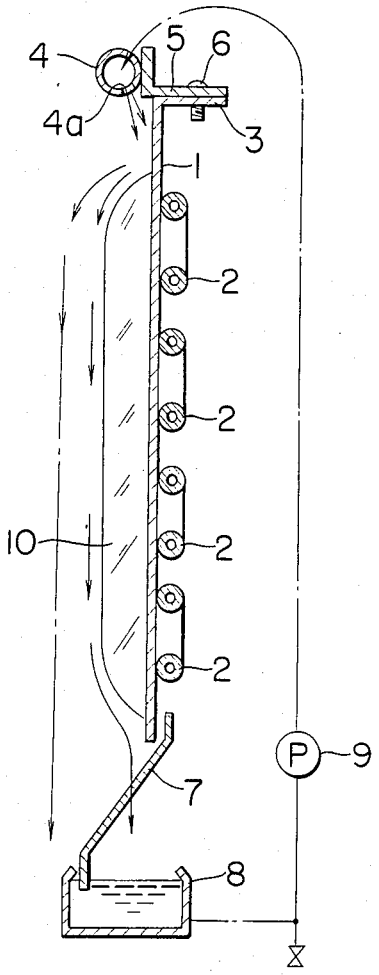
FIG. 1 (PRIOR ART)
FIG. 1 is a schematic side elevation showing the overall construction of the conventional water spray unit for the ice product making machine or apparatus.

The parts or components similar to those of the prior art device shown in FIG. 1 are designated by the same reference numerals.

Figure 2:
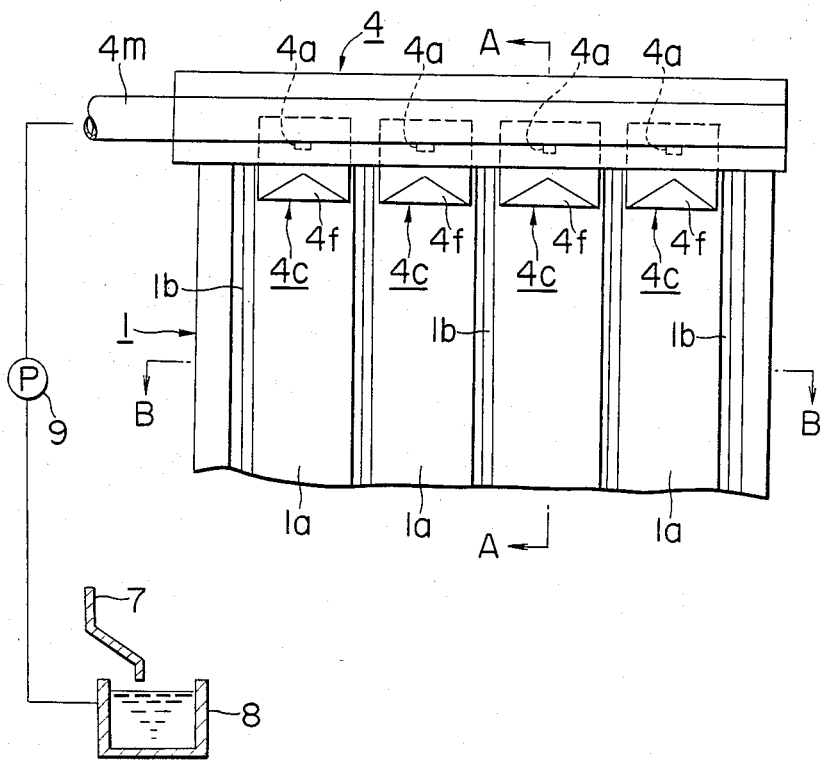
FIG. 2 is a frong view showing a water spray unit for the ice product making machine according to the presnt invention.
Figure 3:
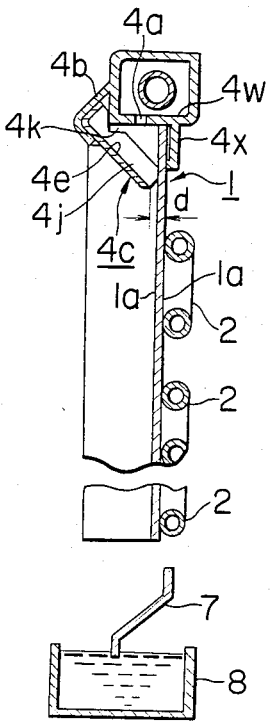
FIG. 3 is a sectional view taken along line A—A of FIG. 2.
Figure 4:
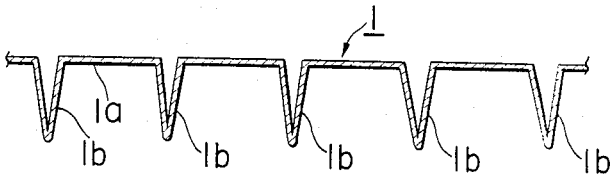
FIG. 4 is a sectional view taken along line B—B of FIG. 2.

Referring to FIGS. 2 to 4, a freezing plate 1 is mounted upright and has an evaporator 2 of the cooling system. On a surface 1*a* of the freezing plate 1, there are integrally formed a number of guide ribs or projections 1*b* that extend vertically and are spaced apart transversely from one another. A main body 4 of the water spray unit has a large number of equidistantly spaced apart water spray apertures 4*a* and is placed on a mounting flange 3 formed on the upper extreme end of the freezing plate 1.

The outer side of the main body 4 of the spray unit is integrally formed with a substantially L-shaped holding plate 4*b* to which water spray guide plates 4*c* are removably mounted in a manner to be later described. These guide plates 4*c* are positioned between the adjoining ones of the guide ribs 1*b* of the freezing plate 1, and a narrow gap or interstice d which will permit the ice-making water to descend therethrough is defined between the foremost part of a main portion 4*e* of each guide plate 4*c* and the surface 1*a* of the plate 1.

Figure 5:
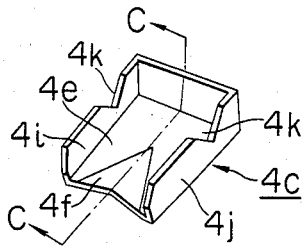
FIG. 5 is a perspective view showing the spray water deflector of the spray unit shown in FIG. 2.

Referring to FIG. 2, the water spray guide plates 4c are detachably mounted in position in register with the spray apertures 4a in the main body 4 of the spray unit mounted to the upper extreme end of the freezing plate 1. The water spray guide plate 4c is constructed and arranged as shown in perspective in FIGS. 5 to 7. Thus a trigonal elevation 4f is formed integrally with the main portion 4e of the water spray guide plate 4c, in such a manner that the base of the elevation 4f is as the open edge of the main portion 4e and terminated short of upright side flanges 4i, 4j of the main portion 4e of the water spray guide plate 4c. These side flanges 4i, 4j are formed with cut-outs or notches 4k in register with a corner of the main body 4 of the water spray unit 4. Thus the foremost part of the water spray guide plate 4c (the side of the guide plate 4c opposite to the trigonal elevation 4f) may be fitted between the holding plate 4b and the corner of the main body 4 of the water spray unit, as shown in FIG. 3, for removably mounting the guide plate 4c to the main body 4 of the spray unit.

Figure 6:
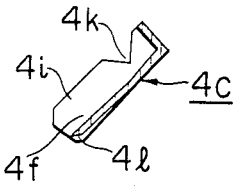
FIG. 6 is a sectional view taken along line C—C of FIG. 5.
Figure 7:
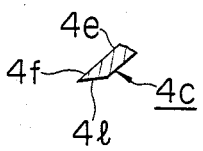
FIG. 7 is an enlarged partial view showing the end of the spray water deflector shown in FIG. 6.
Figure 8:
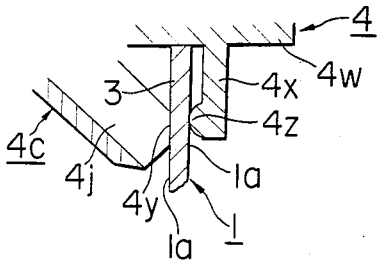
FIG. 8 is an enlarged partial view of the essential parts shown in FIG. 3.

The back side (that is, the side opposite to that on which flows the ice-making water) of the trigonal elevation 4f is chamfered at the forward edge at 4l so that the ice-making water flowing on the upper side of the elevation 4f does not make a detour towards the back side of the elevation 4f (FIGS. 6 and 7).

The bottom plate 4w of the main body 4 of the water spray unit is formed integrally with a substantially downwardly extending resilient lug or porjection 4x. When the main body 4c of the spray unit is secured in position on the freezing plate 1, the abutting beveled edges 4y of the upright side flanges 4i, 4j of the guide plates 4c and an abutting rib 4z of the resilient lug 4x abut on the opposite sides 1a of the freezing plate 1 for clamping and holding the freezing plate 1.

A deflector 7 and an ice-making water saucer or reservoir 8 are mounted below the freezing plate 1, and the ice-making water accommodated in the reservoir 8 is supplied under pressure to an inlet 4m of the water spray unit 4 by pump 9.

In the operation of the water spray unit for the ice-making machine or apparatus according to the present invention, as the evaporator 2 associated with the freezing plate 1 is chilled by the refrigerant or cooling medium delivered thereto from a compressor, not shown, the freezing plate 1 is chilled to a temperature sufficient for ice making. When the pump 9 is now set into operation, the ice-making water accommodated in the reservoir 8 is supplied under pressure through the inlet 4m into the main body 4 of the spray unit. The ice-making water flows through the spray apertures and reaches the main portion 4e of the water spray guide plate 4c to be then deflected towards left and right sides by the angular elevation 4f so as to flow uniformly without being concentrated towards the center of the main portion 4e. By virtue of the chamfered edge 41, the water is guided without making a detour towards the reverse side of the guide plate 4c. It is then guided through the interstice between the freezing plate 1 and the opening of the water spray guide plate 4c to flow on the side 1a of the freezing plate 1 without turbulence so that a uniform ice layer is formed on the side 1a of the freezing plate.

Figure 9:
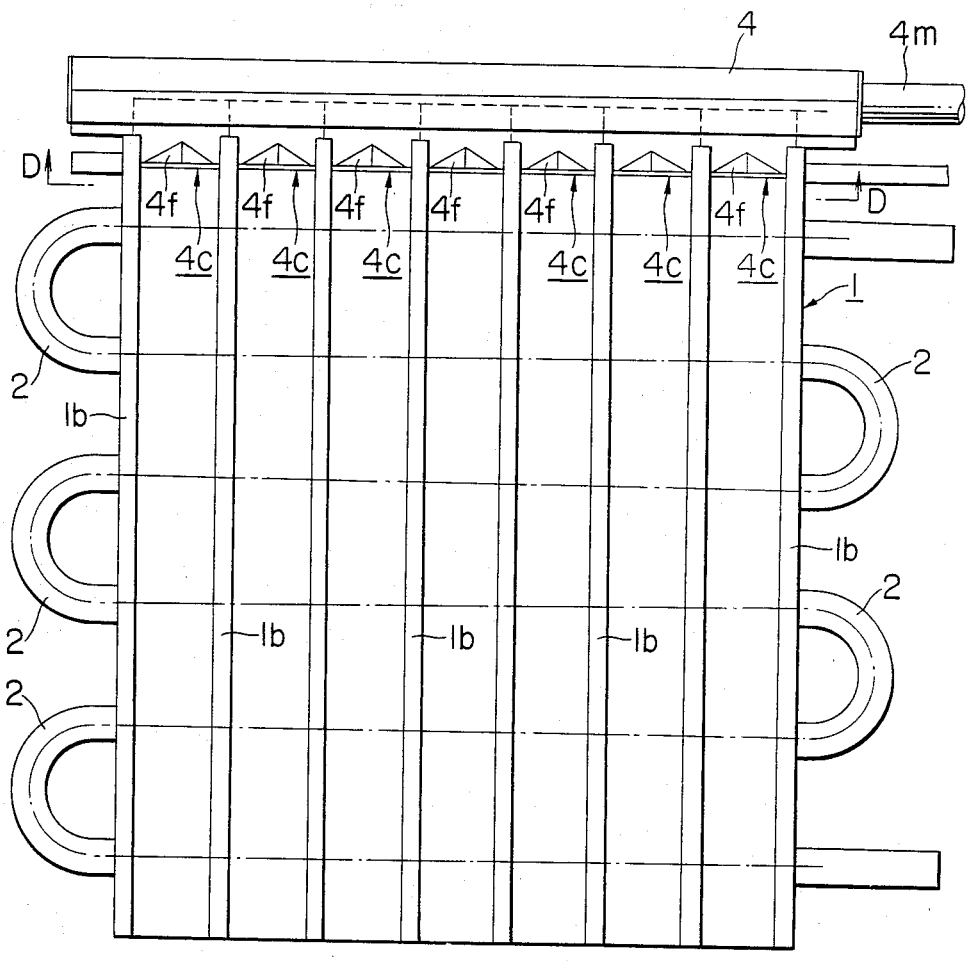
FIG. 9 is a front view showing a modification of the water spray unit.
Figure 10:
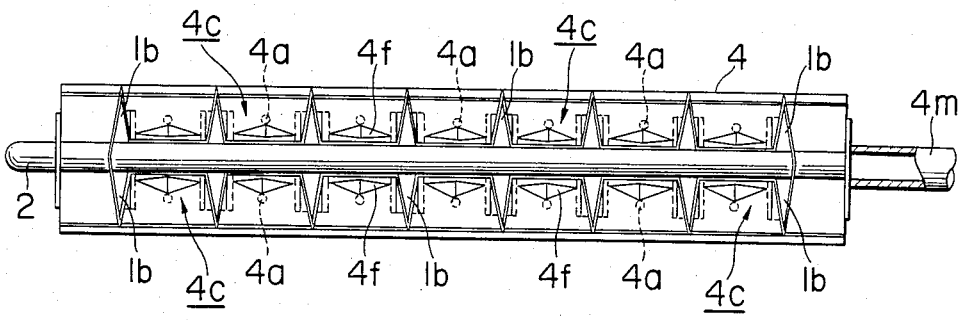
FIG. 10 is a sectional view taken along line D—D of FIG. 9.
Figure 11:
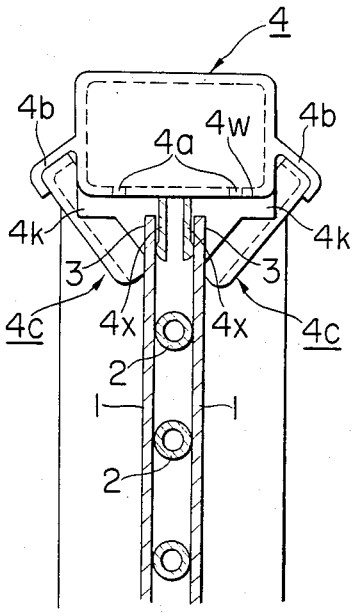
FIG. 11 is a side elevation showing a further modification of the water spray unit

In the above described embodiment, the ice layer is formed on the side of a single freezing plate. However, the present invention may be applied with the same effect to the case in which the ice-making water is supplied to the sides of a pair of confronting freezing plates, as shown in FIGS. 9 to 11.

Referring to these figures, the outer sides of the main body 4 of the water spray unit are integrally formed with a pair of L-shaped mounting flanges 4b, 4b, to which water spray guide plates 4c, 4c are mounted removably as described in the foregoing.

The front and back sides of a pair of freezing plates 1, 1 are engaged by beveled edges 4y of the upright side flanges 4i, 4j of the water spray guide plates 4c, 4c and a pair of desirably slightly resilient lugs 4x, 4x provided to the bottom plate 4w of the main body 4 of the water spray unit for securing the main body 4 of the spray unit to the upper extremity of the freezing plates 1. The guide plates 4c are separately removably mounted intermediate the guide ribs or projections 1b in register with the spray apertures 4a by means similar to those shown in FIGS. 2 and 3.

In the above described construction and operation of the water spray unit for the ice product making machine or apparatus according to the present invention, the ice making water can be supplied uniformly via spray apertures to the side or sides of the freezing plate or freezing plates without causing turbulence or concentration at the center of the water spray guide plate or making a detour towards the back sides of the guide plates by virtue of the trigonal elevation, the upright side flanges and the chamfered edges of the guide plates. In addition, the guide ribs 1b are effective to prevent the water from a given spray aperture from mixing with the water from the adjacent spray aperture so that a uniform stream of the ice-making water is produced with the result that the ice layer can be formed smoothly to a uniform thickness.

The respective water guide plates are separately mounted at a preset distance from one another in such a manner that turbulence of the ice-making water may be prevented effectively and the necessity for making an adjustment at the time of assemblying these guide plates can be practically eliminated.

Prior to manufacture of the water spray unit, the various design data of the unit such as size or position of the resilient lug of the main body of the spray unit or the angle of the beveled edge of the water guide plate are set experimentally so that the optimum falling state of the icemaking water is obtained. Once the components of the water spray unit are fabricated on the basis of the design data obtained in this manner, it is unnecessary to perform any posterior adjustment, but even an unskilled person is able to attach the main body of the spray unit to the freezing plate with one hand for obtaining the optimum falling state of the ice-making water.

What we claim is:

1. A water spray unit for an ice product making machine or apparatus, said spray unit comprising an evaporator of the refrigerating system, and an upright freezing plate having a plurality of guide ribs or projections extending vertically and spaced apart transversely at a preset distance from one the other, characterized in that the spray unit comprises further a main body of the spray unit mounted to an upper portion of the freezing plate, said main body having a side wall portion and a bottom plate, a plurality of water spray guide plates provided intermediate said guide projections and laterally of said main body of the spray unit, a pair of upright side flanges formed on both sides of the water spray guide plate and parallel to said guide projections and a series of spaced apart water spray apertures formed lengthwise in the side wall portion of said main body of the spray unit, and in that the ice-making water sprayed through said spray apertures is caused to flow uniformly on said freezing plate by way of said water spray guide plate, upright side flanges and the guide projections.

2. The water spray unit according to claim 1, wherein each water spray guide plate has a terminal inner surface which has a central trigonal elevation projecting in the same direction as the upright side flanges and diverging towards the downstream side with respect to the downfall direction of the ice-making water.

3. The water spray unit according to claim 2, wherein the trigonal elevation has the terminal edges, the lower sides of which are chamfered.

4. The water spray unit according to claim 1, wherein the bottom plate of the main body of the unit has a depending lug and wherein the freezing plate is clamped between said lug and the upright side flanges for setting the fixed position of the main body of the spray unit on the freezing plate.

5. The water spray unit according to claim 1, wherein the main body has the profile of a transversely elongate box or casing the exterior side of which is integrally formed a substantially L-shaped holding plate in an inclined position, the upright side flanges of the water spray guide plates are provided with notches substantially corresponding in configurations to the corner of the main body of the spray unit, and wherein each water spray guide plate is held by said main body of the spray unit by engagement of said water spray guide plate with said corner and the L-shaped holding plates.

6. The water spray unit as claimed in claim 1, wherein the upright side flanges of the water spray guide plate abut on the freezing side or surface of the freezing plate at the downstream ends relative to the falling direction of the ice-making water in such a manner that a preset interstice is maintained between said freezing side and the lower extremity of the water spray guide plate.

7. The water spray unit according to claim 4, wherein the upright side flanges of the water spray guide plate abut on the freezing side or surface of the freezing plate at the downstream ends relative to the falling direction of the ice-making water in such a manner that a preset interstice is maintained between said freezing side and the lower extremity of the water spray guide plate.

8. A water spray unit for an ice product making machine or apparatus, said spray unit comprising a pair of freezing plates facing to each other on both sides of an evaporator of the refrigerating system, said freezing plates each having a plurality of guide ribs or projections extending vertically and spaced apart transversely at a preset distance from one the other, characterized in that the spray unit comprises further a main body of the spray unit in the form of a transversely elongated box or casing having a bottom wall portion and two exterior side wall portions contiguous to one another via two bottom side corners and said bottom wall portion, with a pair of substantially L-shaped holding plates extending from said exterior side wall portions with the terminal end parts thereof directing inwardly and towards each other, said bottom wall portion presenting a number of longitudinally spaced apart spray apertures and with a plurality of holding lugs extending from the exterior surface of said bottom wall portion and into the space defined between the upper extreme ends of said freezing plates, and a plurality of water spray guide plates mounted intermediate the exterior side wall portions of the main body of the spray unit and said freezing plates and introduced between the adjoining ones of the guide projections, said water spray guide units each having a main portion and a pair of upright side flanges extending parallel to said guide projections from the side edges of said main portion, said upright flanges each having a notch substantially corresponding in configuration to the bottom side corner of said main body of the spray unit, said water spray guide plates being held in position by said main body of the spray unit by engagement of said L-shaped holding plates and the bottom side corners with the water spray guide plates, with the upright side flanges of the water spray guide plates abutting on the freezing sides or surfaces of said freezing plates by the downstream side terminal end portions thereof relative to the downfall direction of the ice-making water so as to delimit a preset interstice between the freezing surfaces and the lower extreme ends of the water spray guide plates, said upright side flanges cooperating with the holding lugs for clamping said main body of the water spray unit into said freezing plates for setting the fixed position of said main body of the water spray unit on said freezing plates.

9. The water spray unit according to claim 8, wherein each water spray guide plate has a terminal inner surface which has a central trigonal elevation projecting in the same direction as the upright side edges and diverging towards the downstream side with respect to the downfall direction of the ice-making water.

10. The water spray unit according to claim 9, wherein the trigonal elevation has terminal edges, the lower sides of which are chamfered.

* * * * *